US005086918A

United States Patent [19]

D'Antonio

[11] Patent Number: 5,086,918

[45] Date of Patent: Feb. 11, 1992

[54] CIGARETTE CASING HAVING A BUTTON-ACTUATED LEVER EJECTOR

[76] Inventor: Michael P. D'Antonio, 45 Farmstead Rd., New Windsor, N.Y. 12553-7611

[21] Appl. No.: 733,877

[22] Filed: Jul. 22, 1991

[51] Int. Cl.[5] ..... B65D 85/10

[52] U.S. Cl. ..... 206/250; 206/252; 206/804

[58] Field of Search ..... 206/249, 250, 252, 253, 206/236, 804; 131/182

[56] References Cited

U.S. PATENT DOCUMENTS

| | | | |
|---|---|---|---|
| 576,653 | 2/1897 | Bowlby | 206/250 X |
| 1,505,748 | 8/1924 | Tamis | 206/252 X |
| 1,876,680 | 9/1932 | Holtzman | 206/250 |
| 1,928,759 | 10/1933 | McQuillen | 206/250 |
| 1,988,546 | 1/1935 | Duhan | 206/253 X |
| 2,391,453 | 12/1945 | Goldbert | 206/250 X |
| 4,252,237 | 2/1981 | Badit | 206/236 X |

*Primary Examiner*—Bryon P. Gehman
*Attorney, Agent, or Firm*—H. Jay Spiegel

[57] ABSTRACT

A portable cigarette caddy is disclosed which includes a mechanism designed to allow easy dispensing of cigarettes one at a time from a container. The mechanism includes a lever pivotable on a fulcrum which lever pushes a cigarette through an opening in the container which is closed by a cover operable at the same time as the lever is actuated. The device may be suitably attached to a wall surface within a vehicle and may also have a separate detachably attached container sized and configured to hold a cigarette lighter.

6 Claims, 1 Drawing Sheet

CIGARETTE CASING HAVING A BUTTON-ACTUATED LEVER EJECTOR

BACKGROUND OF THE INVENTION

The present invention relates to a portable cigarette caddy. In the prior art, containers designed to hold and allow dispensing of cigarettes are known. In this regard, Applicant is aware of U.S. Pat. Nos. 1,505,748 to Tamis, 1,988,546 to Duhan, 2,207,593 to Lorant and 2,625,937 to Sperry. Each of these references teaches a device for holding and dispensing a tobacco product. Tamis teaches such a device wherein cigarettes are lifted out of the container responsive to lifting of the lid thereof. However, neither Tamis nor any of the other references listed above teaches or suggests all of the aspects of the present invention, especially the simultaneous opening of a door and dispensing of a cigarette in the particular manner disclosed herein.

SUMMARY OF THE INVENTION

The present invention relates to a portable cigarette caddy. The present invention includes the following interrelated objects, aspects and features:

(a) In a first aspect, the present invention includes a generally rectangular cubic casing having an internal chamber sized and configured to store a plurality of cigarettes therein.

(b) Within the chamber, a mechanism is provided which allows dispensing of cigarettes one at a time. The mechanism includes a lever pivotably mounted over a fulcrum with one end of the lever being actuated by a push button having an elongated rod coupled thereto with the other end of the lever underlying a corner of the chamber where cigarettes may be transported.

(c) The top of the casing has an opening closed by a sliding cover with the cover being operatively connected to the push button and elongated rod so that when the push button is depressed, concurrently with movements of the lever, the sliding cover is slid to an open position.

(d) Underneath the end of the lever adjacent the elongated rod, a compression spring is provided which provides a restoring force to restore the position of the button to the position before actuation. In that position, the sliding cover has been slid to the closed position thereof.

(e) In a further aspect, a back surface of the casing may be provided with attachment means such as hook and pile fastening means to allow removable attachment of the casing to an adjacent wall surface, such as such a surface in a vehicle.

(f) Additionally, a side wall of the casing may have attached thereto a separate container sized and configured to receive a cigarette lighter.

As such, it is a first object of the present invention to provide an improved portable cigarette caddy.

It is a further object of the present invention to provide such a device including a casing containing cigarettes and a mechanism including a lever and a fulcrum which is actuated by pushing of a button to cause concurrent opening of a cover and dispensing of a single cigarette from the internal chamber of the casing.

It is a still further object of the present invention to provide such a device including a detachable separate container designed to hold a cigarette lighter.

It is a still further object of the present invention to provide such a device including attachment means to allow attachment of the device to an adjacent wall surface.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
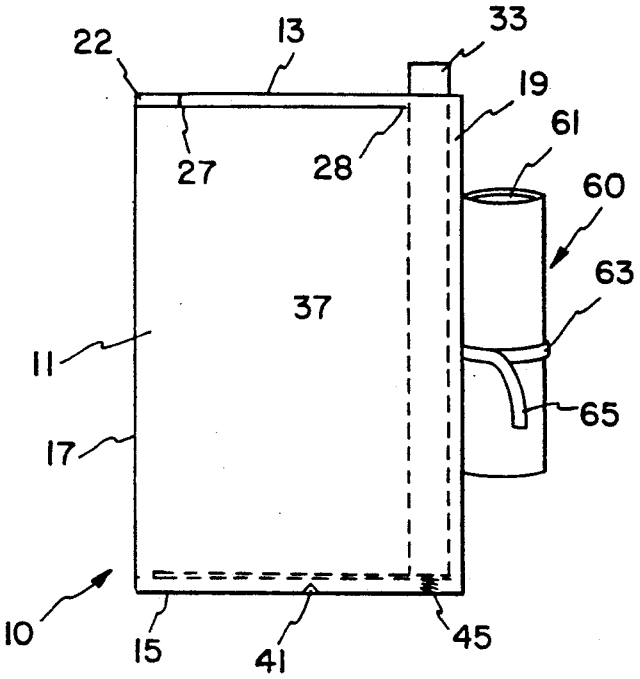
FIG. 1 shows a front view of the present invention with portions removed to show detail.

With reference to the figures, the present invention is generally designated by the reference numeral 10 and is seen to include a casing 11 of generally rectangular cubic configuration having a top wall 13, a bottom wall 15, side walls 17 and 19 and a rear wall 21.

Figure 4:
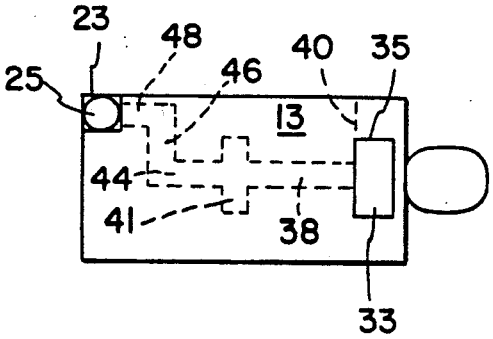
FIG. 4 shows a top view of the present invention with portions thereof shown in phantom.

As seen in FIG. 4, the top wall 13 has an opening 23 in one corner thereof which is sized and configured to allow a cigarette 25 to be slid therethrough.

Figure 3:
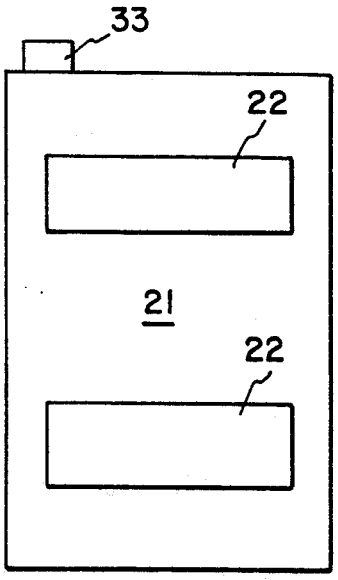
FIG. 3 shows a further front view in a second configuration of parts and with details of the sliding cover being shown in a second orientation thereof.

As seen in FIGS. 1 and 3, a cover 27 is movable between the position shown in FIG. 1 wherein it covers the opening 23 and the position shown in FIG. 3 wherein the opening 23 is exposed.

With further to reference to FIGS. 1, 3 and 4, the mechanism of the present invention will be described in greater detail. Firstly, it should be understood that the casing 11 defines an internal chamber designated by the reference numeral 31 in FIG. 3. This internal chamber is sized and configured to receive a plurality of cigarettes therein of which the cigarette 25 is shown in FIGS. 3 and 4.

As shown in FIGS. 1, 3 and 4, an actuator button 33 protrudes through an opening 35 in the top wall 13 of the casing 11. This button is connected to an elongated rod 37 shown in phantom in FIGS. 1 and 3, which rod has a distal end bearing on one end 39 of a lever 38 which is pivotably placed on a fulcrum 41. The other end 43 of the lever 38 is located within the chamber 31 in a position underlying and aligned with the opening 23. As shown in phantom in FIG. 4, the lever 38 has a first leg 44, a second leg 46 generally perpendicular thereto and a third leg 48 perpendicular to the leg 46 and parallel to the leg 44, which leg 48 has the end 43 seen in FIG. 3.

A compression spring 45 is located underneath the end 39 of the lever 38 and tends to move the end 39 of the lever 38 in an upward direction against force applied downwardly on the button 33.

With reference to FIG. 4, it is seen that the elongated rod 37 has a lateral projection 40 which is aligned with the opening 23 in the top wall 13 of the casing 11. This projection 40 has attached thereto an end 28 of the sliding cover 27. As seen in FIG. 3, the portions of the sliding cover 27 adjacent the end 28 thereof are flexible to allow the curvature of those portions of the sliding cover 27 as seen in the configuration of the sliding cover 27 seen in FIG. 3. The remaining portions of the cover 27 which are designated by the reference numeral 30 in FIG. 3 slide within side recesses formed in the casing 11. While these recesses are not shown in detail in the drawings, it should be understood by those skilled in the art that these recesses constrain movements of the portion 30 of the cover 27 to linear movements as shown by comparing FIGS. 1 and 3 while the portion of the cover adjacent the end 28 thereof is not constrained by these recesses and is able to flex as shown. The end 28 of the cover 27 is attached to the elongated rod 37 by any suitable means such as, for example, welding, gluing, adhesive, etc.

Figure 2:
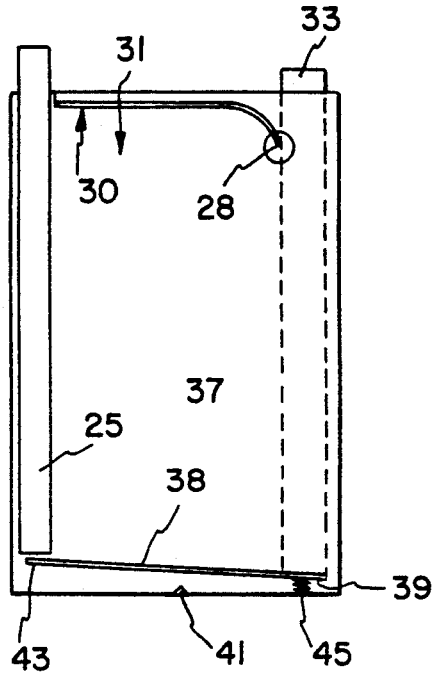
FIG. 2 shows a rear view of the present invention.

With reference to FIG. 2, it is seen that the rear wall 21 of the casing 11 has a pair of strips 22 of securing material which may, if desired, comprise one-half of a hook and pile fastening means. The other halves of this fastening means may be affixed to a surface, such as, for example, an internal wall surface within a vehicle passenger compartment to allow easy mounting and removal of the casing 11 in such location.

With reference to FIG. 1, it is seen that the side wall 19 of the casing 11 has removably attached thereto a container 60 having an internal chamber 61 sized and configured to removably receive a portable cigarette lighter (not shown). The container 60 may be removably fastened to the side wall 19 by suitable fastening means such as, for example, the hook and pile fastening means designated by the reference numeral 63 in FIG. 1. Additionally, a strap 65 may be provided on the container 60 as desired.

In the operation of the present invention, if desired, the side wall 17 may be provided with means allowing it to be opened to allow loading of cigarettes within the internal chamber 31 of the casing 11. With such access closed, when it is desired to dispense a cigarette from the chamber 31, first, the chamber is shaken or manipulated in such a way that a cigarette 25 is located in the corner of the casing aligned with the opening 23. When the button 33 is pressed downwardly in the view of FIGS. 1 and 3, as the cigarette 25 begins to rise within the chamber 31, at the same time, the downward movement of the elongated rod 37 causes the end 28 of the cover 27 to be pulled downwardly thereby causing the cover 27 to slide rearwardly as compared to the opening 23 thereby allowing the opening 23 to be completely exposed just before the cigarette 25 would otherwise engage the cover 27. Further downward movements of the button 23 result in the cigarette 25 moving to the position shown in FIG. 3 wherein a sufficient amount of the cigarette 25 is exposed to allow it to be grasped by the user. Once the cigarette has been removed from the chamber 31 by the user, release of the button 33 will allow the compression spring 45 to push the end 39 of the lever 38 upwardly to restore the button 33 to its original position and allow the cover 27 to be restored to the closed position shown in FIG. 1. A cigarette lighter may be removed from the container 60 and may be used to light the cigarette whereupon the cigarette lighter may be restored to its position within the chamber 61 of the container 60. Through the use of the fastening means 22, the device 10 may be suitably fastened on any wall location as desired.

Through the use of the present invention, especially, where used in a vehicle, safer vehicle operations should result. The use of the present invention will prevent the user from fumbling around looking for a cigarette while they are driving. All of the devices necessary to smoke will be located in a single location allowing the user to grasp the cigarette lighter from the container 60, to push the button 33 to dispense a cigarette 25 from the casing 11, to light the cigarette using the cigarette lighter and to thereafter restore the cigarette lighter to its location within the container 60. The fastening means 22 allows convenient placement of the device 10 as desired.

As such, an invention has been disclosed in terms of a preferred embodiment thereof which fulfills each and every one of the objects of the invention as set forth hereinabove and provides a new and useful portable cigarette caddy of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

I claim:

1. A cigarette casing comprising:

a) a housing having an internal chamber receiving a plurality of cigarettes;

b) said housing having a top wall having (1) an opening sized to receive a cigarette therethrough and (2) an actuator button protruding therefrom, said housing having a cover movable from a first position closing said opening to a second position exposing said opening; and c) an actuator for causing dispensing of a cigarette from said chamber comprising:

i) a lever pivotable on a fulcrum, one end of said lever being aligned below said opening and another end of said lever being aligned below said button; and ii) a linkage operatively connected between said another end of said lever and said button and cover whereby with a cigarette supported on said one end of said lever, depression of said button results in simultaneous movement of said cover to said second position thereof and reciprocation of said cigarette through said opening.

2. The invention of claim 1, further including a compression spring below said another end of said lever.

3. The invention of claim 1, wherein said cover includes a flexible portion adjacent said linkage.

4. The invention of claim 3, wherein said linkage comprises an elongated rod between said button and said another end of said lever, said flexible portion of said cover being movable with said rod.

5. The invention of claim 1, wherein said housing has attachment means for removable attachment of said housing to an adjacent structure.

6. The invention of claim 1, further including a container removably attached to said casing, said container having a chamber sized and configured to receive a cigarette lighter.

* * * * *